United States Patent [19]

Stahlecker et al.

[11] Patent Number: 4,819,419

[45] Date of Patent: Apr. 11, 1989

[54] ARRANGEMENT FOR PNEUMATIC FALSE-TWIST SPINNING

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 108,218

[22] Filed: Oct. 14, 1987

[30] Foreign Application Priority Data

Nov. 7, 1986 [DE] Fed. Rep. of Germany ..... 3638110

[51] Int. Cl.[4] ..... D01H 15/00

[52] U.S. Cl. ..... 57/261; 57/72; 57/328

[58] Field of Search ..... 57/22, 261, 315, 328, 57/333, 350, 352

[56] References Cited

U.S. PATENT DOCUMENTS

| | | | |
|---|---|---|---|
| 4,107,911 | 8/1978 | Yamana et al. | 57/261 X |
| 4,114,358 | 9/1978 | Tsuchida et al. | 57/328 X |
| 4,169,350 | 10/1979 | Yamana et al. | 57/261 X |
| 4,484,436 | 11/1984 | Nakayama et al. | 57/328 |
| 4,545,193 | 10/1985 | Tanaka et al. | 57/328 X |
| 4,593,521 | 6/1986 | Stalder | 57/328 |
| 4,598,537 | 7/1986 | Kroupa et al. | 57/328 X |

FOREIGN PATENT DOCUMENTS

| | | |
|---|---|---|
| 3048481 | 7/1982 | Fed. Rep. of Germany . |
| 3411577 | 10/1984 | Fed. Rep. of Germany . |
| 57-89623 | 6/1982 | Japan . |
| 59-204925 | 11/1984 | Japan . |
| 61-16322 | 1/1986 | Japan . |
| 61-183325 | 4/1986 | Japan . |

*Primary Examiner*—Donald Watkins

*Attorney, Agent, or Firm*—Barnes & Thornburg

[57] ABSTRACT

An arrangement is disclosed for pneumatic false-twist spinning having a drafting roller device, at least two air nozzles that are arranged behind one another in the travel direction of the yarn, a yarn withdrawal device and means for the transfer of the movably held air nozzles from an operating position following a pair of delivery rollers of the drafting roller device into a piecing position that is offset with respect to the pair of delivery rollers. It is provided that a movably held suction tube is assigned to the drafting roller device, the suction tube, by means of an adjusting device, is able to be applied to the pair of delivery rollers of the drafting roller device when the air nozzles are moved out of the operating position.

33 Claims, 12 Drawing Sheets

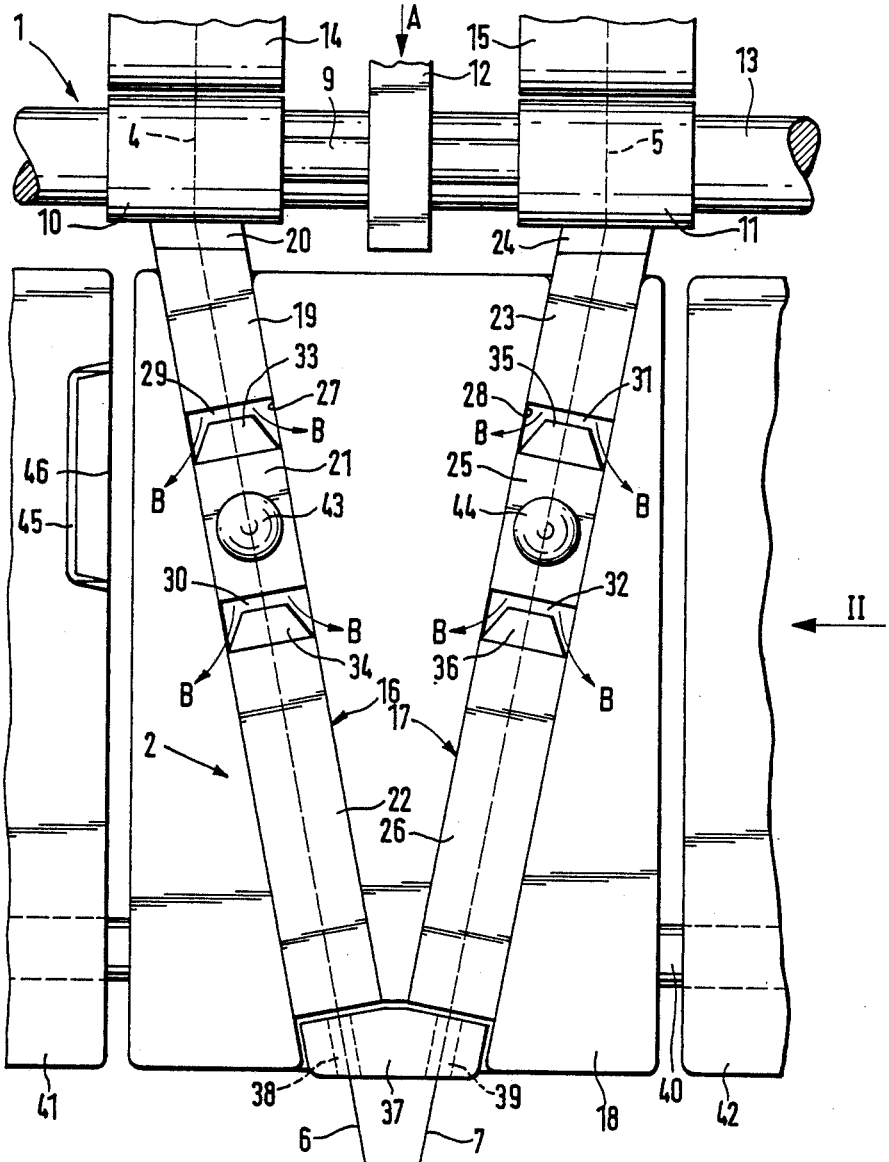
Fig. 1
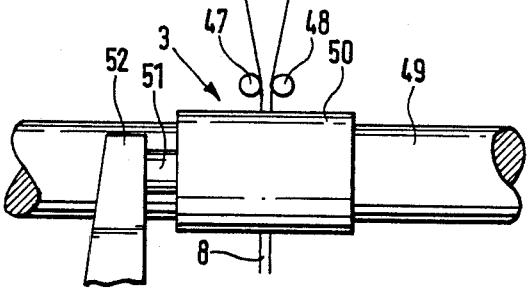

Fig. 3
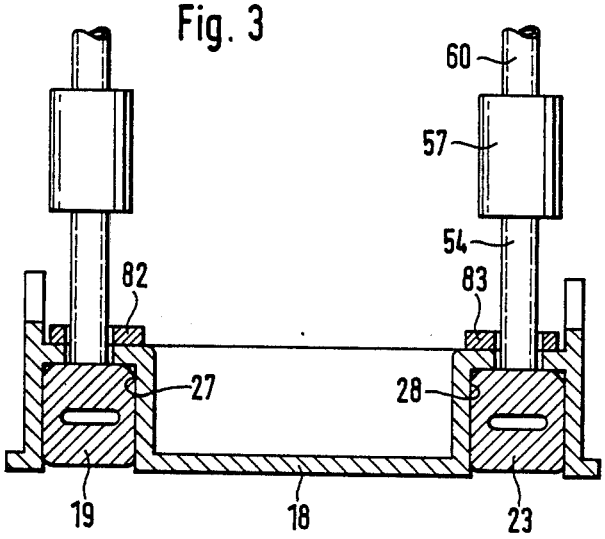
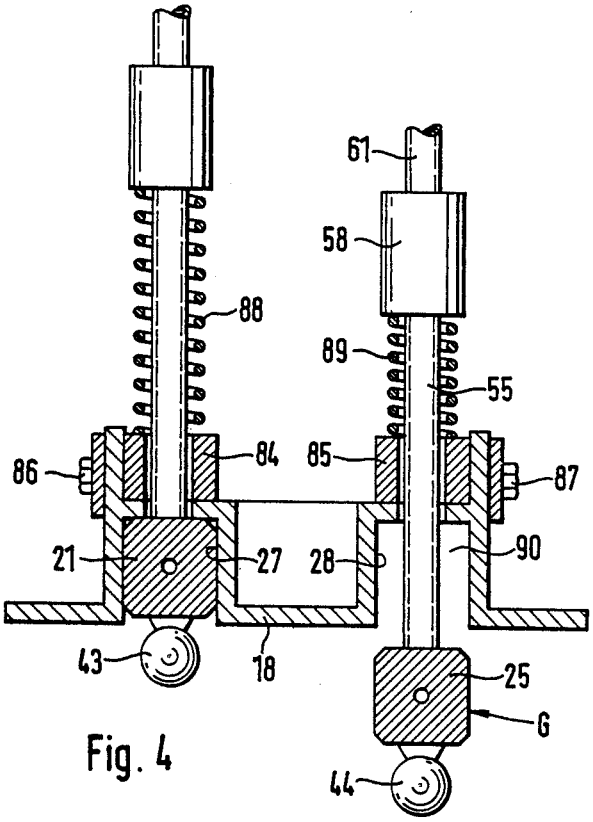
Fig. 4

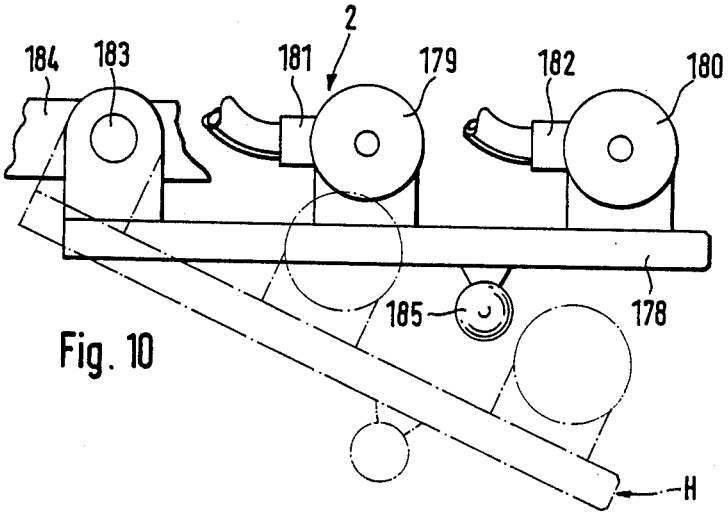
Fig. 10
Fig. 11
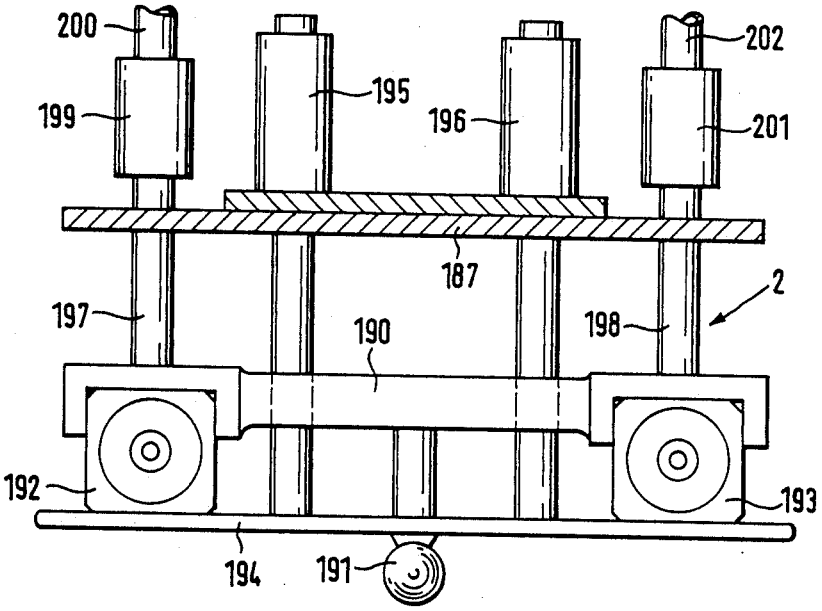

ARRANGEMENT FOR PNEUMATIC FALSE-TWIST SPINNING

BACKGROUND AND SUMMARY OF THE INVENTION

The invention relates to an arrangement for pneumatic false-twist spinning having a drafting frame with drafting rollers, having at least two air nozzles arranged behind on another in the travel path of the yarn, a yarn withdrawal device and a transfer device for transferring the movably held air nozzles from an operating position following a pair of delivery rollers of the drafting roller device to a piecing position that is offset with respect to the pair of delivery rollers.

Reference is made to our invention described and claimed in U.S. application, Ser. No. 105,813, filed on Oct. 8, 1987, based on German priority application No. 36 34 464.8 filed in Germany on Oct. 9, 1986. This other application relates to a piecing process and arrangement.

In the case of a known arrangement of the initially mentioned type, German Published Unexamined patent application (DE-OS) No. 34 11 577, that has only one air nozzle, this air nozzle, by means of a shifting motion on a guide device extending in parallel to the shafts of the drafting rollers can be brought into a piecing position. In this piecing position, a yarn that is withdrawn from the spool is guided back through the air nozzle which subsequently is moved back into its operating position. The returned yarn is placed in the pair of delivery rollers of the drafting roller device that is then started just like the withdrawal device, whereby the yarn, together with the newly supplied sliver, is introduced into the air nozzle. In the case of this construction, a coordination with the starting of the drawing roller means with respect to time is required, on the one hand, while, on the other hand, the newly supplied fiber moves directly into the air nozzle and is tied into the yarn. The danger exists in this case that the starting part of the entering sliver has not yet been drawn or drafted correctly so that thick points may be created that may lead to a clogging of the air nozzle.

It is also known from Japanese Patent Application (JP-OS) No. 61-6322 to arrange two air nozzles that are combined to a structural unit so that they can be shifted on a slideway in parallel to the shafts of the drafting rollers. A suction pipe is integrated into the slideway that, in the operating position, takes in the outgoing air of the first air nozzle. In the piecing position, the opening for the outgoing air between the air nozzles is closed off by the slideway.

In the case of another known arrangement from Japanese Patent Application (JP-OS) No. 57-89623, the air nozzles that are combined to a structural unit can be swivelled around a shaft that can be swivelled in parallel to the shafts of the drafting roller device. The air nozzles can be swivelled in such a way that they can be swivelled into a piecing position in which the inlet opening of the air nozzle that is first in the yarn travel path, is applied to a suction pipe so that a yarn that must be returned can be sucked through the air nozzles.

In the case of another known construction from Japanese Patent Application (JP-OS) No. 59-204 925, it is provided that the air nozzle can be swivelled around a shaft extending in parallel to the shafts of the drafting rollers into a piecing position in which, while the pair of delivery rollers of the drafting roller device are opened at the same time, a suction nozzle can be applied to the inlet of the air nozzles. By means of this suction nozzle, a yarn is guided back through the air nozzles and is at the same time then placed in the pair of delivery rollers of the drafting roller device.

In the case of another known arrangement from Japanese Patent Application (JP-OS) No. 61-83325, two air nozzles, in a cylindrical bore of a joint holding device, can be shifted into a piecing position, in which the compressed-air supply mean is assigned to different areas of the nozzles.

In all these constructions, there is the above-described problem, namely that a time coordination with the restarting of the drafting roller device is necessary and that the sliver that is supplied from the time of the starting of the drafting roller device is already tied into the yarn that may possibly not have been drawn or drafted correctly.

An objective of the invention to develop an arrangement of the initially mentioned type in such a way that during a piecing process, a time coordination with the starting of the drafting roller device is not required, in which case it is ensured at the same time that only a sliver that was drawn correctly in the drafting roller device is supplied to the air nozzles and tied into the yarn.

This objective is achieved according to the invention by assigning to the drafting roller device a movably held withdrawal tube that can be applied by an adjusting arrangement to the pair of delivery rollers of the drafting roller device when the air nozzles are moved out of the operating position.

By means of this development, it is possible to restart the drafting roller device before the actual piecing process so that the piecing is carried out while the drafting roller device is already operating. The sliver that had been supplied immediately before the piecing process and may not be drafted or drawn correctly is sucked off by means of the suction tube and is not tied into the yarn. It is only the sliver that is supplied continuously by the drafting roller device after the air nozzles were returned to the operating position that is tied into the yarn. It is contemplated in certain embodiments, before the piecing, to return a yarn through the air nozzles that is withdrawn after the air nozzles were moved back into the operating position and that then connects itself with the newly supplied sliver. However, embodiments are also contemplated where piecing is accomplished without the guiding-back of a spun yarn, in that the sliver, that was furnished after the air nozzles were returned into their operating position, is sucked through the air nozzles, is subsequently placed in the withdrawal device and is then transferred to a wind-on device.

In a further development of certain preferred embodiments of the invention, it is provided that means are provided for the joint transferring of the air nozzles and of the suction tube into the piecing position. In an advantageous development, it is further provided that the means for the joint transfer contain a driving or triggering element that is controlled by a yarn guard. In the case of a yarn breakage, the air nozzles and the suction tube therefore automatically arrive in the piecing position.

In order to avoid losses of fiber material after a yarn breakage, after which a certain time period elapses until the piecing takes place, it is provided that means are provided for the interruption of the supply of the drafting roller device that are controlled by a yarn guard.

In a further development of certain preferred embodiments of the invention, it is provided that for the transfer of the air nozzles and of the suction tube into the piecing position and for the interruption of the supply of the drafting roller device, an adjusting mechanism is provided that contains a joint actuating element that is controlled by a yarn guard. As a result, in the case of a yarn breakage, the arrangement is transferred automatically into the piecing position In order to be able to carry out a piecing while the drafting roller device is already operating, it is provided in a further development of the invention that the adjusting mechanism is designed in such a way that at least the supply of the drafting roller device can start operation in the piecing position of the air nozzles.

In a further development of certain preferred embodiments of the invention, it is provided that to two adjacent drafting roller device that are equipped with twin pressure rollers, two rows of in each case at least two air nozzles and a joint withdrawal device for a double end are assigned, in which case all air nozzles are arranged on a joint holding device. This arrangement is particularly useful for producing only prestrengthened ends which, however, do not yet have the strength of a yarn. The prestrengthening is therefore only carried out to such an extent that these ends that are guided together to form a double end can be wound onto a spool. Subsequently, this spool is supplied to a twisting machine or the like whereby the yarn gains its final strength. In the case of an arrangement of this type, the use of two suction pipes is advantageous, i.e., of one suction pipe for each drafting roller device because then the piecing can be carried out from operating the drafting roller device in which case no yarn must be supplied back.

In a further development of certain preferred embodiments of the invention, it is provided that the two rows of air nozzles approach one another in a V-shape in the travel direction of the yarn. As a result, the guiding-together of the yarns into a double end is carried out at least partially already in the area of the air nozzles.

In an advantageous development of certain preferred embodiments of the invention, it is provided that a bifurcated guiding element is connected behind the air nozzles of both rows, said guiding element containing the guiding ducts that are assigned to the two rows, which guiding ducts leading out into a joint connecting surface. As a result, it is possible to suck off simultaneously by means of a joint suction tool the air nozzles of both rows for a piecing in which the sliver entering at both drafting roller device is used without a returned yarn.

In order not to interfere with the sucking off of the newly supplied slivers, it is provided in a further development of certain preferred embodiments of the invention that between the outlet of the last air nozzle of each row and the bifurcated guiding element, guiding elements having guiding ducts are arranged. As a result, closed air ducts can be created through which the suction air flow is also transmitted securely. For the same purpose, adjustable cover elements are provided in a further development of certain preferred embodiments of the invention in order to at least partially close gaps between the air nozzles and/or the guiding elements.

In a further development of certain preferred embodiments of the invention, it is provided that the holding device is provided with two groove-type guides that extend in the travel path of the yarn and into which the air nozzles and/or the guiding elements are inserted. As a result, it is possible to provide the arrangement in the area of the air nozzles with a smooth closed front.

In order to permit a servicing that exceeds the operations of the normal piecing process and, for example, includes a cleaning and/or exchanging of air nozzles, it is provided in a further development of certain preferred embodiments of the invention that the holding device can be moved from the piecing position into a servicing position. In this servicing position, the essential elements will then be easily accessible. In this case, it is possible to carry out the movement into the servicing position as a continuation of the movement that takes place from the operating position into the piecing position, or to carry out a movement that deviates from it with respect to the direction and/or the type. It is, for example, contemplated to carry out the change-over into the piecing position as well as the change-over into the servicing position as swivel movements around a joint shaft. It is, however, also contemplated in certain embodiments of to provide different shafts for the two movements that are to be carried out as swivel movements, the shafts extending, for example, in planes that are directed perpendicularly with respect to one another. It is also contemplated in certain embodiments, particularly for the movement into the piecing position, to carry out a linear movement by means of which only the distance between the inlet opening of the air nozzles and the drafting roller device is increased, while the movement into the servicing position is carried out as a swivel movement.

In a further development of certain preferred embodiments of the invention, it is provided that the holding device has a plate-shaped design and, on the back side, is provided with a holding device for holding the air nozzles and/or the guiding elements and/or with means for the supplying of compressed air to the air nozzles. In this case, it is particularly advantageous if the holding device can be swivelled around a horizontal shaft into the servicing position in which it has an approximately horizontal position. In this case, the back side will be accessible from above in the manner of a table top or a work top.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic view from the direction of the operating side of an arrangement constructed according to a preferred embodiment of the invention depicting a spinning machine having a plurality of adjacently arranged spinning units;

FIG. 3 is a sectional schematic view through a holding device for air nozzles of the FIG. 1 embodiment, shown in the operating position of the air nozzles;

FIG. 4 is a sectional view similar to FIG. 3, but depicting an air nozzle that is in a servicing position;

FIG. 10 is a schematic partial view of another preferred embodiment of the invention, in which case the air nozzles, by means of a joint holding device, can be swivelled into a piecing position around a shaft that is essentially parallel to the travel path of the yarn;

FIG. 11 is a schematic partial sectional top view of another preferred embodiment of the invention in which case the air nozzles of both rows on a slideway can be moved out of their operating position;

DETAILED DESCRIPTION OF THE DRAWINGS

Figure 2:
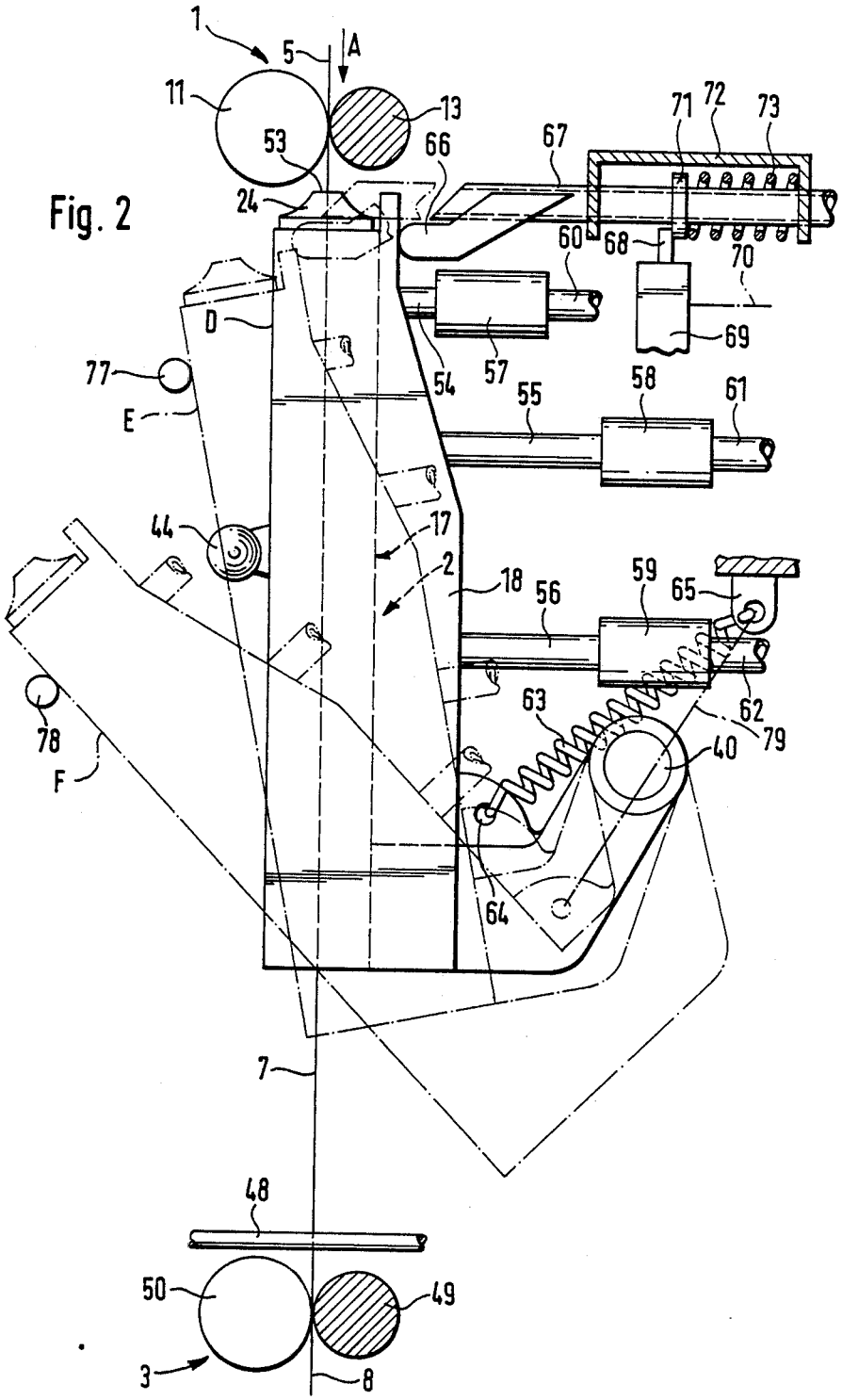
FIG. 2 is a schematic view taken in the direction of the Arrow II in FIG. 1, with certain parts omitted to facilitate the illustration.

In FIG. 1, an arrangement is shown that serves as one of many spinning points or units of a spinning machine. Each spinning unit includes a drafting roller device 1, a pneumatic false-twist zone 2 and a withdrawal device 3 that are arranged behind one another in the travel direction (A) of the yarn. Behind the withdrawal device 3, a wind-up device is connected that is not shown. Two slivers 4, 5 move through the drafting roller device 1 where they are drawn or drafted to the desired yarn count. The slivers 4, 5 then proceed to the respective false-twist zones where they approach one another in a V-shape so that the two drawn slivers 6, 7 approach one another already in the false-twist zones 2. No later than in front of the withdrawal device 3, the slivers are combined into a double end 8 that is wound onto the spool in a multiple-wound way.

In order to facilitate a clearer illustration of the invention, in certain drawing Figures, such as FIGS. 1 and 2, structural member depicted in one Figure illustrating an embodiment are deleted from another Figure illustrating the same embodiment.

The drafting roller device 1, shown only partially and only in the area of the pairs of delivery rollers, contains joint pressure roller twins of which the top delivery rollers 10, 11 are shown that interact with the bottom cylinder 13 that passes through in the longitudinal direction of the machine. The upper delivery rollers 10, 11 are arranged on a joint shaft 9 that, in a known way, is held by means of a load carrier 12 that can be swivelled around an axis that is parallel to the shaft 9. Of the illustrated drafting roller device 1, the two top aprons 14, 15 that precede the top delivery rollers 10, 11 are partially shown.

The pneumatic false-twist zone 2 has two rows of air nozzles 16, 17 that approach one another in a V-shape in the travel direction (A) of the yarn. These rows of air nozzles 16, 17, together with a holding device 18, form a nozzle block. The row of air nozzles 16 contains a first air nozzle 19 that is equipped with a nozzle inlet 20, which first air nozzle 19 is followed by a second air nozzle 21 that is in turn followed by an air nozzle 22. In a corresponding way, in the row of air nozzles 17, a first air nozzle 23 with a nozzle inlet 24 is followed by a second air nozzle 25 as well as a third air nozzle 26. The respective first air nozzles 19, 23 of the rows of air nozzles 16, 17 are developed as so-called suction nozzles that essentially have the objective of taking in the drawn slivers 4, 5. These first nozzles 19, 27 have a relatively strong injection air current in the travel direction (A) of the yarn, although the slivers 4, 5 are not subjected to any significant twist when traveling therethrough. The respective second air nozzles 21, 25 that follow in rows 16, 17 are the actual twist nozzles that produce a false twist in the slivers 4, 5 by means of which prestrengthened yarns 6, 7. are produced. The prestrengthening of these yarns 6, 7, that is obtained essentially by twisting edge fibers around the core of the yarns 6, 7, proceeds only so far that the yarns 6, 7 have a strength that is sufficient for winding them on a spool as a double-end yarn 8 and to process them subsequently by twisting them together. Behind the air nozzles 21, 25, additional air nozzles 22, 26 are connected that are necessary only in special cases and that may be called after-treatment nozzles. These after-treatment air nozzles 22, 26 provide the slivers 4, 5 also with a false twist that may extend in the same direction as the previously provided false twist or also in the opposite direction. When the nozzles 22, 26 are not required according to certain embodiments, they are replaced by guiding elements that have a corresponding outer contour and in each case continuous guiding ducts. As shown in FIG. 1, the air nozzles 21, 15 are disposed leaving a distance 29, 31 to the preceding air nozzles 19, 23. A distance 30, 32 is also left between these air nozzles 21, 15 and the air nozzles 22, 26 that follow so that the outgoing air (B) of the respective preceding air nozzles 19, 23 can flow off. Air nozzles 21, 15 as well as air nozzles 22, 26 have respective truncated-cone-shaped inlet areas 33, 35 and 34, 36 in order to promote the flow-off.

Behind the two last air nozzles 22, 26, a bifurcated guiding element 37 is connected that is provided with two guiding ducts 38, 39 that continue in the yarn-moving direction and lead into a joint outer surface.

The holding device 18, that essentially has a plate-shaped design, is provided with two groove-shaped guideways 27, 28 by which the air nozzles 19 to 26 of the two rows of air nozzles 16, 17 are received. The air nozzles 19 to 26 have the outer contour of a rectangular parallelepiped by means of which they are fitted into these guideways 27, 28. The guideways 27, 28 are so deep that the air nozzles 19 to 26, and also the guiding element 37 are essentially flush with the outer surface of the holding device 18. The fasteners for the air nozzles 19 to 26 as well as the connections for the compressed-air supply thereto are located on the back side of the holding device 18. The air nozzles 19, 23 that follow the drafting roller device 1 directly are fastened in the holding device 18 in a stationary way (FIG. 3). From the direction of the back of the holding device 18, screws are screwed into the air nozzles 19, 23, which screws support themselves on the outside on support plates 82, 83. The air nozzles 19, 23 are also provided with tubes 54 that extend through the holding device 18 and the support plates 82, 83 toward the rear to the outside and via conventional coupling means, are connected with elastic pressure tubes 60. The elastic pressure tubes 60 lead to a compressed-air source that is not shown. In a corresponding way, the air nozzles 22, 26 of the two rows 16, 17, that are in each case last in moving direction (A) of the yarn, are fastened in the holding device 18 and via tubes 56 and coupling elements 59, are connected to flexible pressure tubes 62 (see FIG. 2).

The air nozzles 21 and 25 are fastened at the holding device 18 in such a way (FIG. 4) that they can be moved out of the holding device 18 and therefore out of the alignment with the air nozzles 19, 22 or 23, 26. The air nozzles 21, 25, that in the operating position are guided and centered in the guideways 27, 28, are equipped with tubes 55 used for the compressed-air supply, which tubes 55 are slideably guided in holding rings 84, 85. The holding rings 84, 85 are arranged on the back of the holding device 18 and are fastened thereto by means of screws 86, 87. Between the holding rings 84, 85 and the coupling pieces 58 that each are fastened at the tubes 55, pressure springs 88, 89 are arranged that hold the air nozzles 21, 25 in their operating position, and against the effect of which the air nozzles 21, 25 can be pulled out into a servicing position (G) (FIG. 4). Flexible pressure tubes 61 are connected to the coupling pieces 58 and lead to a compressed air source that is not shown. The air nozzles 21, 25 have handles 43, 44 at which they can be pulled out. By means of the pulling-out of the air nozzles 21 or 25, the outlet area of the relatively stationary air nozzles 19, 23) and the inlet area of the relatively stationary air nozzles 22, 26 is exposed by providing a free space 9 so that they are easily accessible for cleaning. In the pulled-out position (G), the air nozzles are also well accessible for a cleaning or the like.

The holding device 18 is provided with a projection on the lower part of its back side, by means of which it can be swivelled around a horizontal shaft 40 that extends in parallel to the shafts of the drafting roller device (FIG. 2). A tension spring 63 is coupled to one lug 64 of the holding device 18, the other end of spring 63 being fastened at a holding element 65 fastened at the machine frame. By means of this tension spring 63, the holding device 18 is held in the operation position (D) that in FIG. 2 is shown by solid lines. The holding device 18 is brought in this case to rest against a stop 66 by means of the tension spring 63. From this operating position (D), the holding device 18 with the air nozzles 19 to 26 can be swivelled around the shaft 40 into a piecing position (E), in which the inlet opening 53 of the inlet part 20, 24 of the air nozzles 19, 23 that, in a longitudinally oval way, extends in the direction of the wedge-shaped gap of the pairs 10, 13; 11, 13 of delivery rollers of the drafting roller device 1, is swivelled out of the area of the pairs 10, 13; 11, 13 of delivery rollers. In this piecing position (E), the holding device 18 rests against a stop 77. After this stop 77 is removed, the holding device 18 can be swivelled farther into a servicing position (F) that is also shown by dash-dotted lines, in which it rests against a stop 78. The tension spring 63 is arranged in such a way that it is then moved beyond the swivel shaft 40 (dash-dotted position 79) so that it acts as an over-dead-center spring that secures the servicing position (F) of the holding device 18. In this servicing position (F), the back of the holding device 18 is easily accessible for servicing and/or repair work.

The transferring of the holding device 18 with the air nozzles 19 to 26 into the piecing position (E) takes place automatically in the case of a yarn breakage. The stop 66) is mounted on a suction tube 67 that is guided in a U-shaped holding bracket 72 so that it can be moved out at a distance and transversely to the swivel shaft 40. The area of the suction tube 67 that is located in the holding bracket 72 is surrounded by a pressure spring 73 that supports itself at a collar 71 of the suction tube 67 and at a rear leg of the holding bracket 72. The operating position of the suction tube 67 and thus also of the stop 66 is determined by a stop 68 that is assigned to the collar 71. The stop 68 is designed as a piston of an actuating element 69 that can be pulled back from the operating position shown in FIG. 2 when it receives a signal via an electric supply line 70 so that then the collar 71 is exposed, and the pressure spring 73 shifts the suction tube 67 with the stop 66 in the direction toward the drafting roller device 1. The electric supply line 70, in a way that is not shown in detail, is operatively connected with yarn guards that monitor the presence of the prestrengthened yarns 6, 7 and that, in the case of a breakage of one of the two yarns 6 or 7 or also in the case of a breakage of both yarns 6, 7, emits a corresponding triggering signal. A yarn guard of this type that, in particular, may be developed as an electro-optical yarn guard, may be arranged in the area of the guiding ducts 38 and 39 of the guiding element 37. The suction tube 67 is moved in this case out in such a way that its mouth is located in the area of the wedge-shaped gap 78. Note that naturally two suction tubes 67 of this type are provided that are connected to respective vacuum sources that are not shown and in each case are assigned to the pairs 10, 13; 11, 13 of delivery rollers of the two drafting roller device 1.

The yarn guards that, in particular, may be arranged in the area of the guiding element 37, also have the purpose of ensuring that the supply of the sliver 4,5 by the two drafting roller device 1 is interrupted automatically. For this purpose, it may be provided that the drafting roller device 1 is equipped with a so-called sliver-stop device, as it is known, for example, on the basis of German Published Unexamined Application (DE-OS) No. 30 48 481 that is controlled by the yarn guards. It is also contemplated to provide an actuating member that is triggered by the yarn guards and that swivels away the load arm 12 with the top rollers 10, 11 and thus interrupts the continued supply by the drafting roller device 1.

Figure 5:
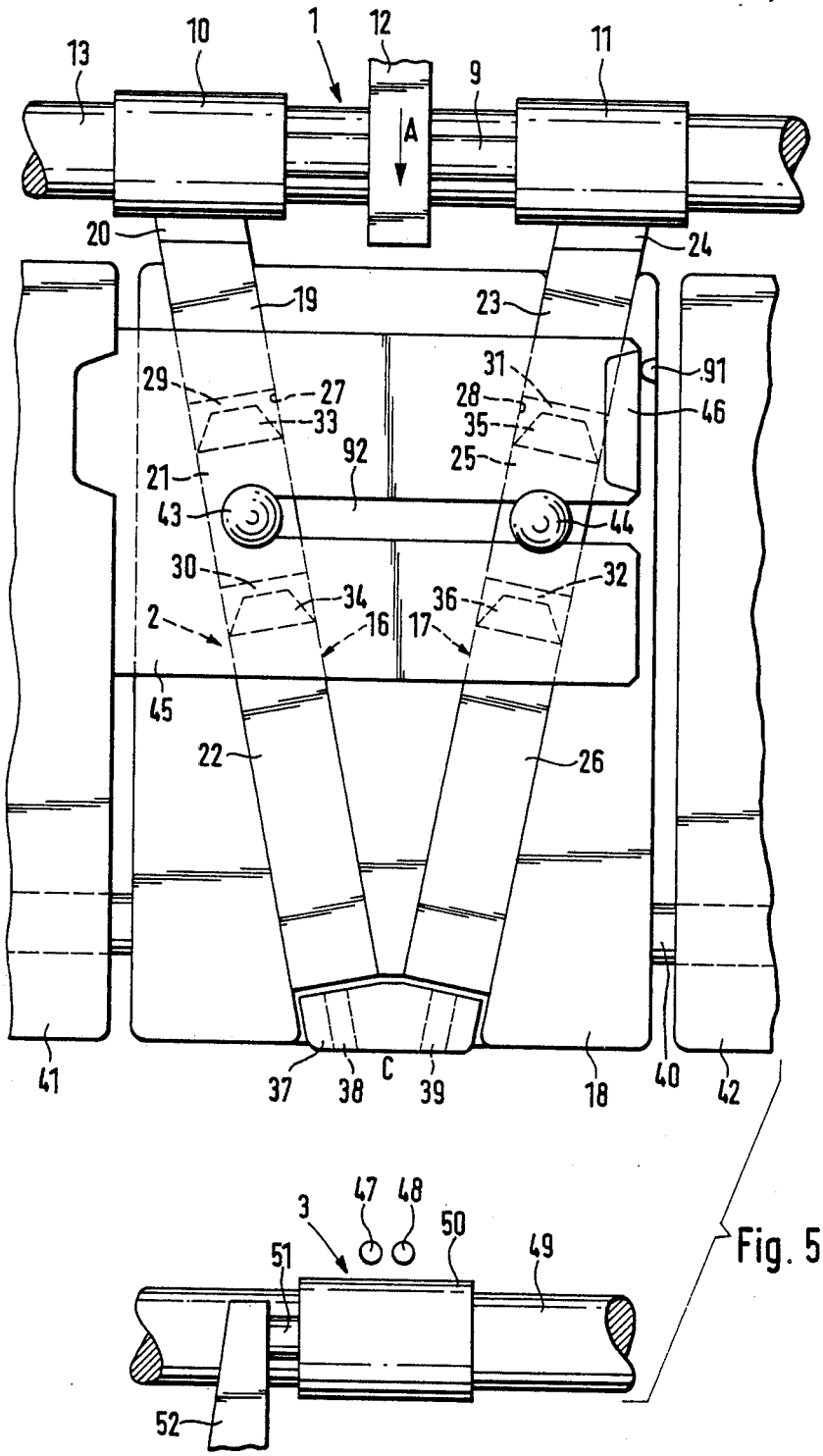
FIG. 5 is a view that is similar to FIG. 1 depicting a construction where the outgoing-air openings between the nozzles are at least partially closed by means of a cover element.

The holding device 18, by means of the swivel shaft 40, is disposed in two laterally arranged supports 41, 42 of the machine frame. In the support 41, an essentially plate-shaped cover element is arranged and sunk into a recess, and by means of a handle 46, can be pushed transversely over the holding device 18 to a stop 91 (FIG. 5) so that the areas between the air nozzles 19, 23 and 21, 25 as well as between the air nozzles 21, 25 and the air nozzles 22, 26 are at least partially closable.

The withdrawal device 3 that is connected behind the false-twist zone 2 has a pair of withdrawal rollers comprising a driven cylinder 49 that moves through in the longitudinal direction of the machine, and of a pressure roller 50 that is pressed resiliently against the cylinder 49. The pressure roller 50 is disposed with a shaft 51 in a pivotable, spring-loaded arm 52. It may be provided in certain preferred embodiments that by means of the yarn guards, an actuating member is also controlled that, in the case of a yarn breakage, lifts the pressure roller 50 off the cylinder 49 so that the withdrawal device 3 is interrupted.

In front of the withdrawal device 3, two yarn guides 47, 48 are connected that guide the two prestrengthened yarns 6, 7 in such a way that they enter the withdrawal device 3 at a short distance from one another, by which they are then transported along as a double yarn 8. The wind-up device that is not shown may also be developed in such a way that, in the case of a yarn breakage reported by the yarn guards, it interrupts the wind-up process in that the spool is lifted off the pertaining winding roller.

After a yarn breakage, that may be caused by a breakage of one of the prestrengthened yarns 6, 7 or also by the using-up of the sliver supply 4, 5, the arrangement is automatically transferred into the piecing position; i.e., the holding device 18 with the nozzles 19 to 26 and the suction tubes 67 are in the piecing position (E). The piecing process may be carried out by an operator or by a mobile piecing unit. The work steps that must be carried out are essentially the same for both and are explained as follows. As the first step, possibly after a cleaning of the drafting roller device 1, the sliver supply is restarted, after which the slivers 4, 5 enter into the suction tubes 67 that are applied to the area of the wedge-shaped gap 78. The starting portion of the slivers 4, 5 that, as a rule, was not drawn or drafted correctly, is sucked into the suction tubes 67 and is not used for the piecing. Then the holding device 18 with the air nozzles 19 to 26 is moved back into the operating position (D), in which case the suction tubes 67 leave the area of the wedge-shaped gap 78. The stop 68 locks behind the collar 71 so that the operating position is fixed. In this case, the slivers 4,5 are cut in the area of the wedge-shaped gap 78 so that they now enter the inlet openings 53). Since the slivers 4, 5 have no significant resistance to tearing, this cutting usually takes place without any further help. If necessary, an additional cutting device may be provided. A suction tool is applied to the bottom side of the bifurcated guiding element 37, to simultaneously suck off the guiding ducts 38, 39. This suction tool will be applied no later than after the holding device 18 was moved back into the operating position (D). The suction tool takes over the two slivers 4, 5 or 6, 7 as a double yarn 8 emerging from the bifurcated guiding element 37 and places them in the withdrawal device 3 and in the wind-up device. If the withdrawal device 3 was not opened automatically in the case of a yarn breakage, it is opened during the inserting. After the inserting of the double yarn 8, the withdrawal device 3 is closed. The double yarn 8 will then move to the wind-up device and, if necessary, will be wound onto a newly inserted spool tube.

If the compressed-air supply of the air nozzles 19 to 26 remains switched on during the piecing, its effect is as a rule sufficient for transporting the slivers 4 and 5 to the outlet at the guiding element 37 so that the suction tool must only take over the prestrengthened yarns 6, 7. Particularly in cases when the compressed-air supply to the air nozzles 19 to 26 is switched off after a yarn breakage and during the piecing, the suction tool will suck the slivers 4, 5 through the air nozzles 19 to 26 and take them over. Particularly in this case, it is advantageous if the areas of the outgoing-air openings 29 to 32 are at least partially closed by the covering 45. This covering 45 that is provided with a slot 92 for receiving the handles 43, 44 ensures that the suction air flow generated by the suction tool reaches into the area of the inlet openings 53 of the air nozzles 19, 23. No later than after the suction tool has taken over the slivers 4, 5, will the air nozzles 19 to 26 again be acted upon by compressed air so that a prestrengthening takes place, and prestrengthened yarns 6, 7 are present for the inserting into the withdrawal device 3 and into the wind-up device. As soon as the compressed-air supply is switched on again, the covering 45 is moved back so that the outgoing-air openings behind the nozzles 19, 23 and 21, 25 are exposed again.

In deviation from the described embodiment, it may also be provided that suction tubes 67 are arranged stationarily at a narrow distance from the operating position of the air nozzles 19, 23 in proximity of the drafting roller device 1. Particularly in this case, it is advantageous for the effect of the suction tubes 67 to be controlled by a valve that also responds to a yarn guard.

Figure 6:
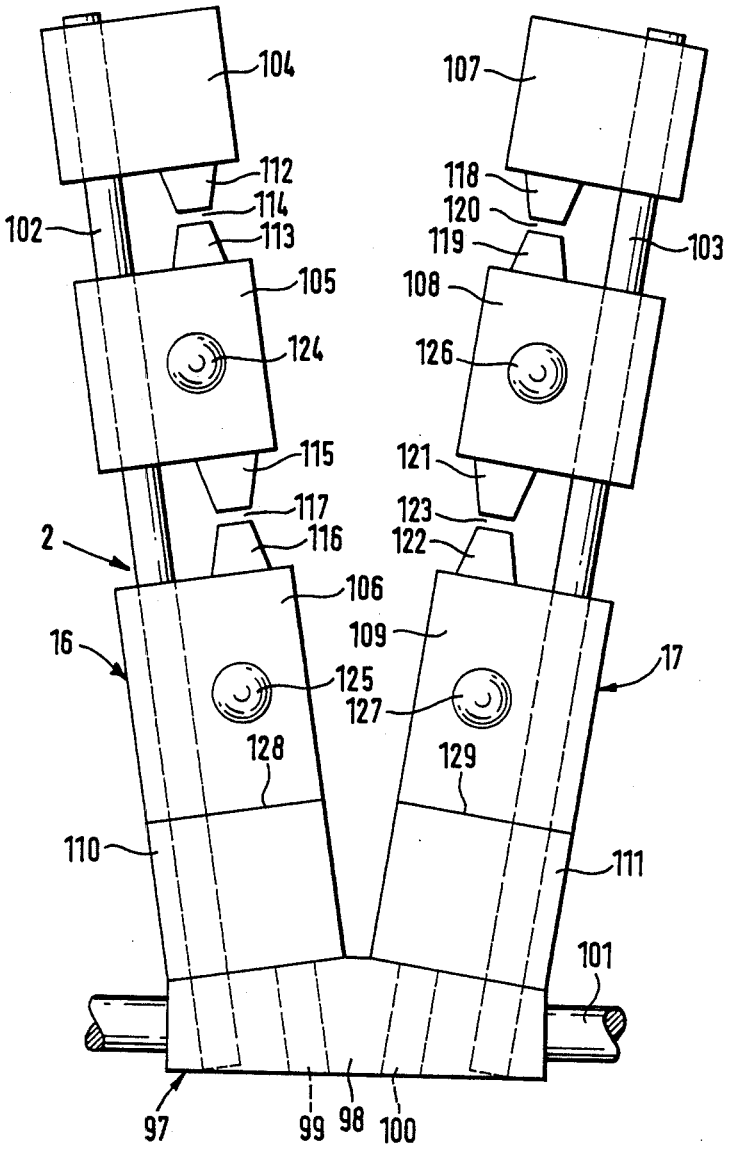
FIG. 6 is a schematic view from the direction of the operating side of a part of a further preferred embodiment of the invention.

In the case of the embodiment according to FIG. 6, a joint holding device 97 is also provided for air nozzles 104, 105, 106 of one row 16 of air nozzles that are arranged behind one another in the travel direction of the yarn and for air nozzles 107, 108, 109 of a second row of air nozzles 17. This holding device 97 consists essentially of a bifurcated guiding element 98 that can be swivelled around a horizontal shaft 101 that extends in parallel to the shafts of the drafting rollers that are not shown, two guide rods 102, 103 being fastened at the guiding element 98 to extend in the respective travel directions of the yarn. The air nozzles 104 to 109 are fastened on the guide rods 102, 103 that come together in a V-shape in the travel direction of the yarn,. Between the two last air nozzles 106, 109 of the two rows of air nozzles 16 and 17 and the guiding element 98, guiding elements 110, 111 are arranged that are used as filling pieces and that, via guiding ducts, connect the air nozzles 106, 109 with the guiding ducts 99, 100 of the guiding element 98.

As shown in FIG. 6, one space 114, 120 is provided respectively between the outlet 112, 118 of the respective suction nozzle 104, 107 and the inlet 113, 119 of the air nozzle 105, 108 that follows and is used as a twisting nozzle, via which space 114, 120 the outgoing air of the respective preceding air nozzle 104, 107 can escape. In a corresponding way, one space 117, 123 respectively is provided between the outlets 115, 121 of the air nozzles 105, 108 and the inlets 116, 122 of the air nozzles 106, 109 that follow.

The air nozzles 104, 107 are stationarily arranged on the guide rods 102, 103. In contrast, air nozzles 105, 106, 108 and 109 can be swivelled by a predetermined angular amount between stops around the guide rods 102, 103 so that the gaps between the air nozzles 104 to 109 and also the parting lines 128, 129 between the air nozzles 106, 109 and the guiding elements 110, 111 can be exposed. The air nozzles 105, 106, 108, 109 are equipped with handles 124, 125, 126, 127.

Also in the case of the embodiment according to FIG. 6, it is provided that the complete holding device 97 can automatically be swivelled into a piecing position around the shaft 101. In this piecing position, the air nozzles 105, 106, 108, 109 can then again be swivelled for servicing purposes.

Figure 7:
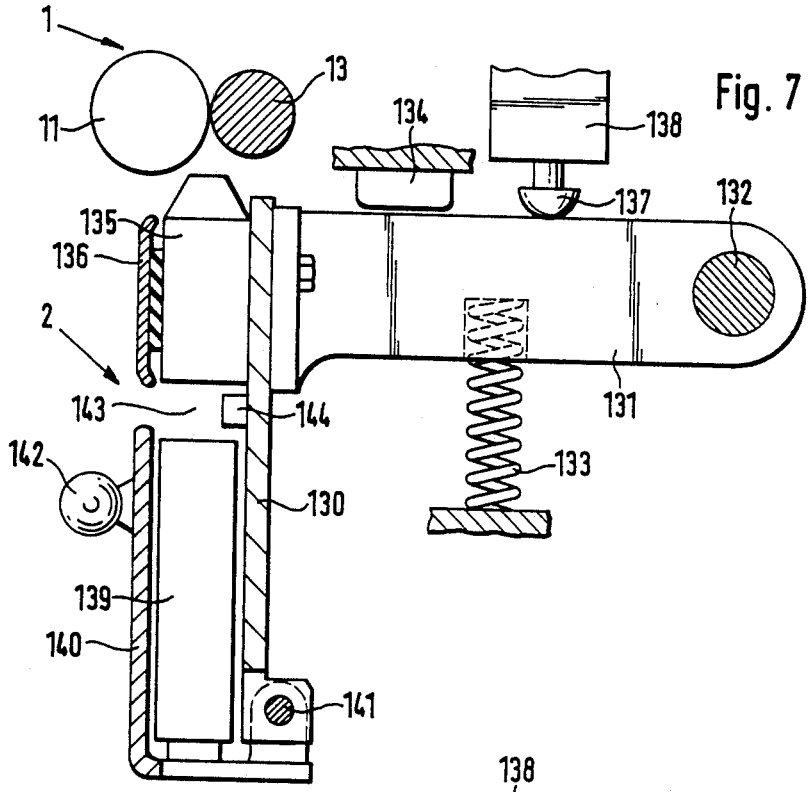
FIG. 7 is a schematic vertical sectional view of a portion of another preferred embodiment of an arrangement constructed according to the invention.

In the case of the embodiment according to FIG. 7, a joint holding device 130 is provided for air nozzles 135, 139 that preferably, also in the case of this embodiment, are provided in pairs in two rows of air nozzles, the holding device 130 being able to be swivelled around a shaft 132 extending in parallel to the shafts of the drafting roller device 11, 13. The essentially plate-shaped holding device 130 is connected via a lever 131 with the swivel shaft 132. A pressure spring 133 supports itself at the lever 131, the other end of which spring is fixed at a stationary machine part. The pressure spring 133 presses the lever 131 against a stop 134 that fixes the operating position of the holding device 130 and thus of the air nozzles 135, 139. The air nozzles 135 that are developed as suction nozzles are stationarily fastened on the holding device 130 and, by means of a covering 136, are covered in the direction of the operating side. The air nozzles 139 that are arranged so that they follow in the travel direction of the yarn are mounted on a holding element 140 that is mounted at the holding device 130 so that it can be swivelled around a shaft 141 extending in parallel to the shaft 132. The holding element 140 is developed as a type of lid that covers the air nozzles 139 in the direction of the operating side. In this area, it is provided with a handle 142.

Between the air nozzles 135, 139, an air gap 143 is located, in the area of which a no-contact yarn guard 144 is arranged for each of the slivers 4, 5. The yarn guards 144 control an actuating member 138 that acts upon the lever 131 by means of a piston 137 that can be moved out to swivel together with the holding device 130 into a piecing position in the case of a yarn breakage. For servicing work, the holding element 140 with the air nozzles 139 can then, in addition, be swivelled into a servicing position so that the air nozzles 135, 139 are generously exposed for servicing work.

Figure 8:
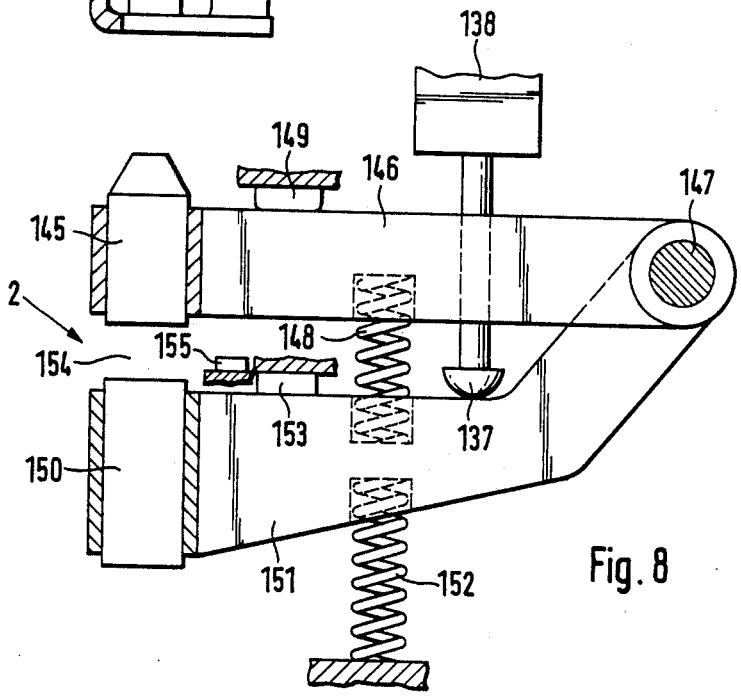
FIG. 8 is a view similar to FIG. 7, depicting another preferred embodiment of the invention.

In the case of the embodiment according to FIG. 8, the air nozzles 145, 150 that are arranged behind one another and that, also in the case of this embodiment, are preferably arranged in pair in two rows of air nozzles, are in each case held by means of respective swivel holding members 146, 151. The two swivel holding members 146, 151 can be swivelled around a swivel shaft 147 that extends in the longitudinal direction of the machine, i.e., in parallel to the shafts of the rollers of the drafting roller device that is not shown in this Figure. The operating positions of the swivel levers 146, 151 and thus of the air nozzles 145, 150 are secured by stops 149, 153. The lever 146 that carries the air nozzles 145 serving as suction nozzles is supported by means of a pressure spring 148 against the lever 151 carrying the air nozzles 150. The lever 151, via another pressure spring 152, supports itself against a stationary part of the machine frame.

By means of yarn guards which, also in the case of this embodiment, are preferably arranged in the area 154 between the air nozzles 145, 150 that are arranged behind one another, an actuating member 138 is operated, the piston 137 of which acts upon the swivel arm 151. When the swivel arm 151 is swivelled away, the swivel arm 146 will follow until it rests against a stop 155. The swivel arm 151 with the air nozzle 150 can be swivelled farther in order to generously expose the area 154 between the air nozzles 145, 150, should this be required for servicing purposes.

Figure 9:
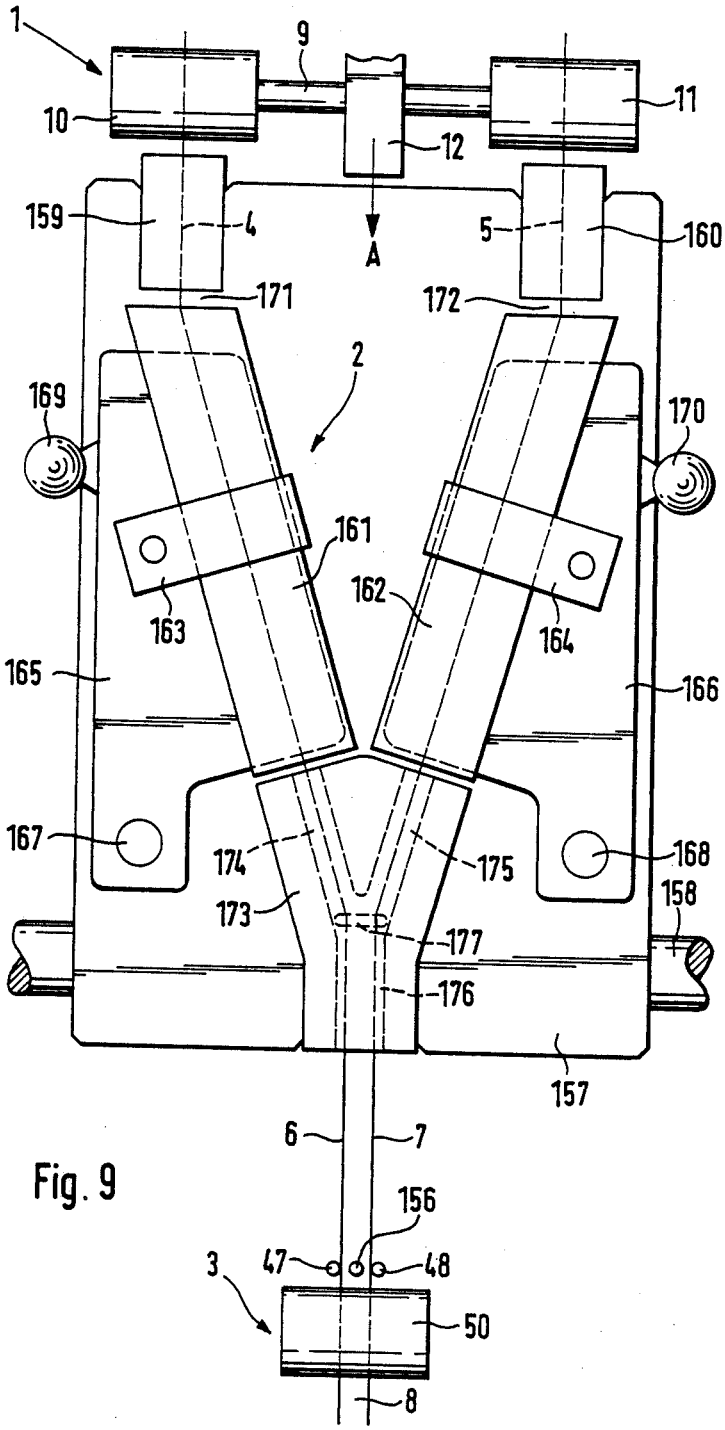
FIG. 9 is a schematic view from the direction of the operating side of another preferred embodiment of the invention.

In the case of the embodiment according to FIG. 9, a joint holding device 157 is also provided for the receiving of air nozzles 159, 161 and 160, 162 that are arranged in two rows. The holding device 157 is able to be swivelled around a horizontal swivel shaft 158 that therefore extends in parallel to the shafts of the drafting roller device 1, into a piecing position and, as necessary, corresponding to FIGS. 1 to 5, into a servicing position. The air nozzles 159, 160 that are developed as suction nozzles are connected as a straight-line extension of the drafting roller device 1. Connected to these are the air nozzles 161, 162 that approach one another in a V-shape and serve as twisting nozzles. Behind these air nozzles 161, 162, a bifurcated guiding element 173 is connected that is also mounted at the holding device 157 and that has two guiding ducts 174, 175 assigned respectively to the air nozzles 161, 162, the guiding ducts 174, 175 combining to a joint guiding duct 176 in the travel direction (A) of the yarn. In the area of the combining point, a wear-resistant yarn guide 177 is advantageously arranged. In the case of this embodiment, a central yarn guide 156 is arranged in the area in front of the withdrawal device 3, in addition to the two yarn guides 47, 48, the central yarn guide 156 keeping apart the two prestrengthened yarns 6, 7 in the inlet area to the withdrawal device 3.

The air nozzles 161, 162 that are developed as twisting nozzles are supported by means of holding elements 165, 166 so that they can be moved relative to the holding device 157. The holding elements 165, 166 are disposed so that they can be swivelled around swivel shafts 167, 168 extending perpendicularly to the swivel shaft 158. The air nozzles 161, 162 are fastened by means of clamps 163, 164 at the holding elements 165, 166. In addition, the holding elements 165, 166 have handles 169, 170 at which the holding elements 165, 166 are gripped and swivelled out of the path of the yarn for a servicing or the like.

In FIG. 10, a partial view of an embodiment is shown that in its basic construction corresponds to the embodiment according to FIG. 9. In the case of this embodiment, air nozzles 179, 180 that are arranged in two rows are held at a joint holding device 184, the air nozzles 179, 180 forming a false-twist zone for two slivers 4, 5 to be prestrengthened. The holding device 184 can be swivelled around a swivel shaft that extends in the longitudinal direction of the machine, into a piecing position. A pair of nozzles, particularly the central air nozzles 179, 180 that serve as the twisting nozzles, are mounted at a holding element 178. Holding element 178 is pivotably supported at a vertical shaft 183 extending essentially in parallel to the travel direction of the yarn so as to be movable in the manner of a door into the servicing position (H shown by dash-dotted lines. In this servicing position (H, the air nozzles 179, 180 as well as the elements that are arranged in front of them and behind them are exposed. In addition, the compressed-air connections 181, 182 are easily accessible. The holding element 178 is equipped with an operating handle 185.

The embodiment according to FIG. 11, in its basic construction, also corresponds, for example, to FIG. 9. Also in the case of this embodiment, a joint holding member 187 is provided for all air nozzles 192, 193. The holding member 187 being mounted for pivotal movement around a swivel shaft that is not shown and extends horizontally and in parallel to the rollers of the drafting roller device, into a piecing position. In this holding element 187, rod guides 195, 196 for a holding element 190 are provided, the holding element 190 containing in each case one air nozzle of the two rows of air nozzles, particularly the central air nozzles 192, 193 that are developed as twisting nozzles. In the operating position and also in the piecing position, the holding element 190 rests against the holding member 187. The holding element 190 can be pulled out of the holding member 187 into the shown servicing position by means of a handle 191 in the manner of a drawer, so that the air nozzles 192, 193, as well as the elements that are located in front and behind them in the travel direction of the yarn, are easily accessible. The tubes 197, 198 that are used for the compressed-air supply of the air nozzles 192, 193 are guided through the holding member 187 and are equipped with coupling pieces 199, 201, by means of which they are connected to flexible compressed-air supply tubes 200, 202. The holding element 190 is provided with a covering 194 that covers the area of the air nozzles 192, 193 so that in the operating position and also in the piecing position, a largely closed front of the holding device 187 is obtained.

Figure 12:
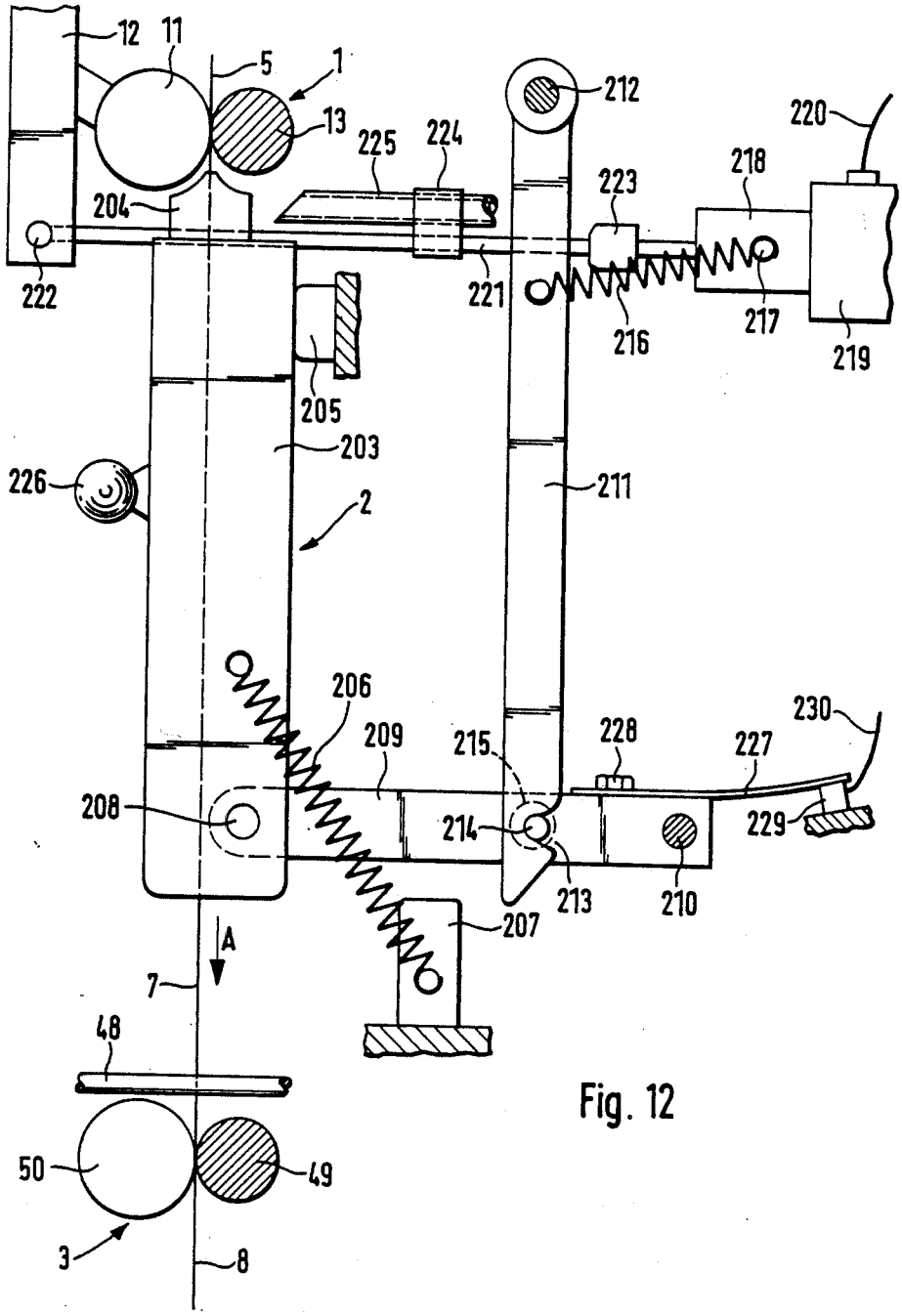
FIG. 12 is a schematic view similar to FIG. 2 depicting another preferred embodiment of the invention having a joint adjusting mechanism for the changing of the air nozzles and the suction tubes into a piecing position and for the opening of the drafting roller device.
Figure 13:
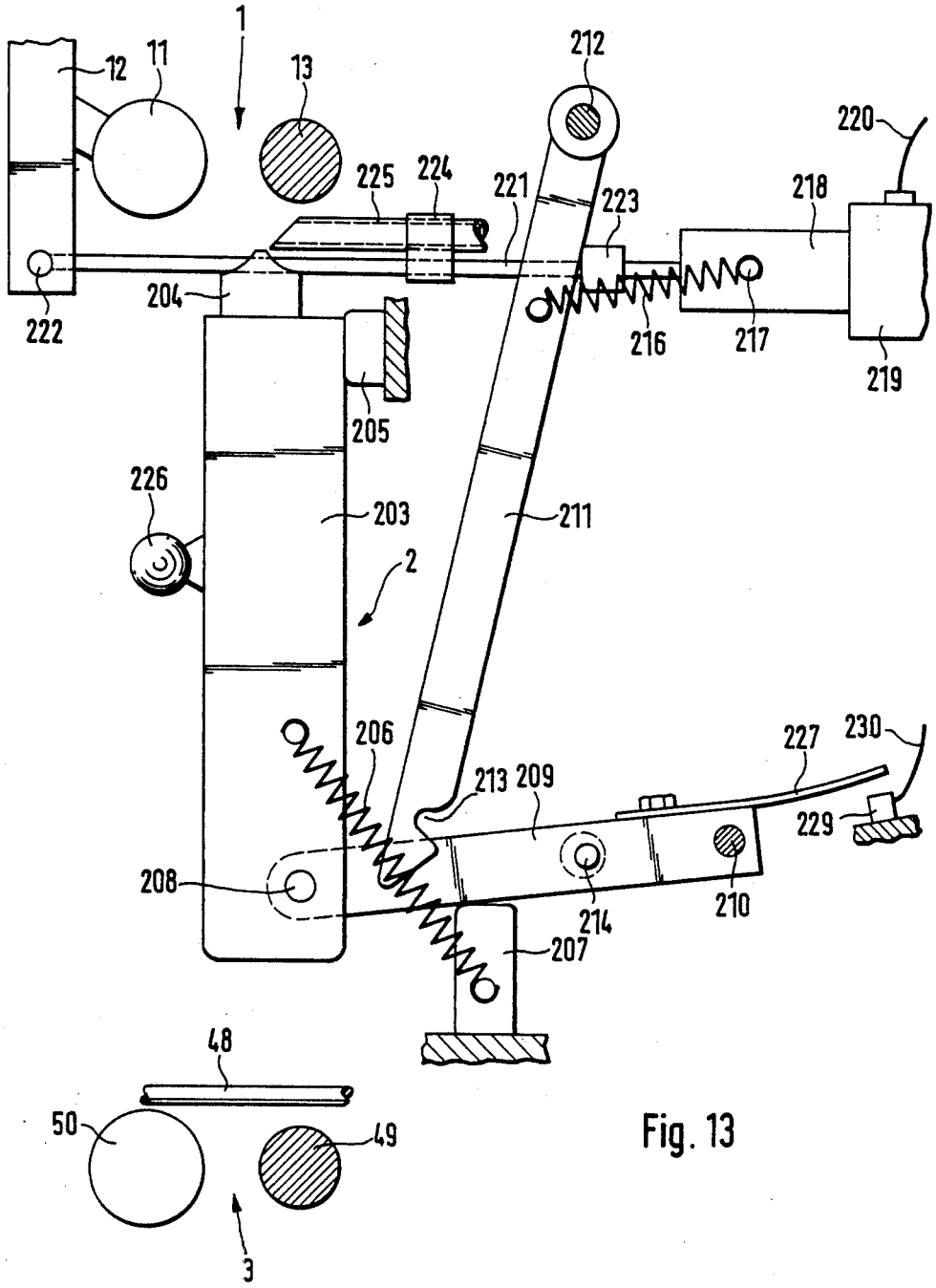
FIG. 13 is a schematic view of the embodiment according to FIG. 12 shown in a piecing position immediately after a yarn breakage.
Figure 14:
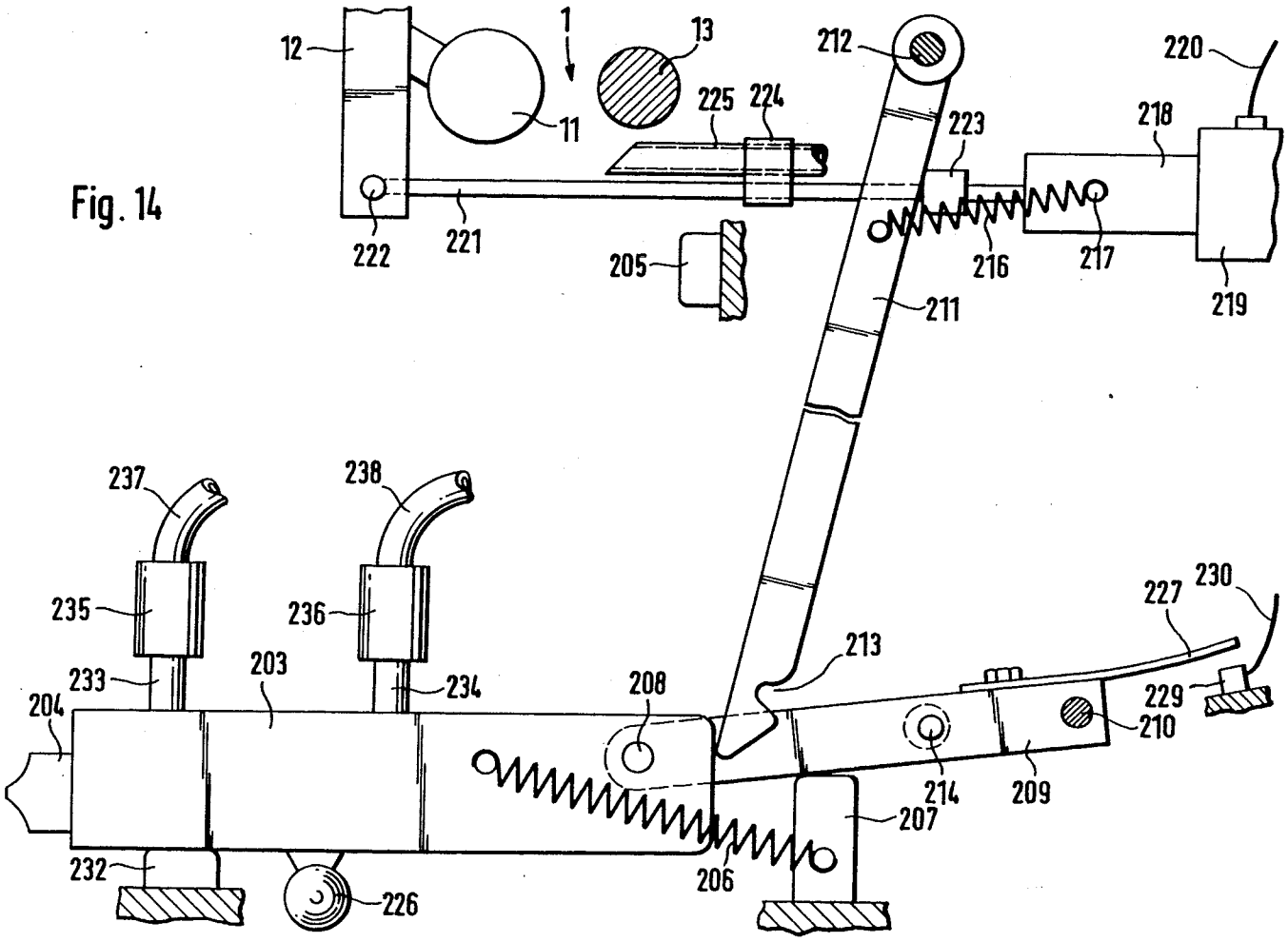
FIG. 14 is a schematic view of the embodiment according to FIG. 12 and 13, shown in a servicing position.

In FIGS. 12, 13 and 14, an arrangement is shown in its operating position (FIG. 12), in its piecing position (FIG. 13) and in its servicing position (FIG. 14). This arrangement contains a holding device 203 that contains air nozzles that are arranged in two rows and are not shown in detail. The whole holding device 203 is shown only in diagram form. This holding device 203 may be constructed in a way that was described with respect to the preceding embodiments, particularly corresponding to the embodiment according to FIG. 1 to 5. The holding device 203 is held by means of a swivel arm 209 that can be swivelled around a swivel shaft 210 extending in the longitudinal direction of the machine, i.e., in parallel to the shafts of the rollers of the drafting roller device 1. The holding device 203 is coupled to the swivel arm 209 with a swivel shaft 208 that extends in parallel to the swivel shaft 210. In the operating position (FIG. 12), the holding device 203 rests against a stationary stop 205. The holding device 203 is pulled against this stop 205 by means of a tension spring 206 that is coupled to it and to a stationary component 207. The operating position of the swivel arm 209 is secured by means of a securing lever 211 that can be swivelled around a shaft 212 that is parallel to the shaft 210, said shaft 212 being arranged at the level of the pairs 11, 13 of delivery rollers of the drafting roller device 1. The securing lever 211 reaches around a pivot 214 by means of a recess 213 that, by means of an eccentric 215, is disposed in the swivel arm 209 and can therefore be adjusted.

When the securing lever 211 is swivelled in such a way that it exposes the pivot 214, the swivel arm 209 swivels downward, in which case the holding device 203 is also lowered, so that the distance increases with respect to the pair 11, 13 of delivery rollers of the drafting roller device 1 (FIG. 13). This corresponds to the piecing position of the holding device 203. The swivelling-away movement of the swivel arm 209 is limited by a stop 207 that advantageously also serves as a counter-bearing for the tension spring 206. In the case of this lowering movement, the holding device 203 slides at the stop 205 that has a corresponding length in lowering direction. The holding device 203, also in the piecing position, is held at the stop 205 by the tension spring 206.

The swivelling-away of the securing lever 211 is effected by an actuating member 219 that is controlled by yarn guards that are not shown. In the case of this embodiment, the actuating member 219 consists of a pneumatic press, the valve of which is acted upon by a signal from the yarn guards via an electric line 220. A pivot 217 is mounted at the piston 218 of the pneumatic press, to which pivot 217 a tension spring 216 is coupled, the free end of which spring 216 is mounted at the securing lever 211. A pressure rod 221 is also mounted at the piston 218, which rod 221 carries a driving stop 223 that is assigned to the securing lever 211 and by means of which the securing lever 211 is swivelled away in the case of a yarn breakage (FIG. 13).

The pressure rod 221, via a holding bracket 224, carries two suction tubes 225 that are assigned to the pairs of delivery rollers 11, 13 of the two drafting roller units of drafting roller device 1 and that, in the case of a yarn breakage, when the holding device 203 is lowered into the piecing position, is applied to the pairs of delivery rollers 11, 13. The pressure rod 221, in addition is applied to the load arm 12 of the pressure roller pair at a coupling point 222 so that the top rollers of the drafting roller device (see top roller 11) are lifted off the pertaining bottom rollers 13, so that as a result the supply of the drafting roller device 1 is automatically interrupted. As shown in FIG. 13, the withdrawal device 3 is also opened by means of actuating members that are not shown in that the pressure roller 50 is swivelled away from the bottom cylinder 49.

From the piecing position shown in FIG. 13, the holding device 203 can be transferred into a servicing position (FIG. 14). For this purpose, the holding device 203 that is equipped with an operating handle 226 is swivelled away farther around the shaft 208 until it is approximately horizontal. The front side of the holding device 203 that will then rest against a stop 232 will then be located in front of the operator in the manner of a table top or work top. The elements that are mounted on the back, particularly the tubes 233, 234 for the compressed-air supply, the couplings 235, 236 and the flexible pressure tubes 237, 238 will then be easily accessible for control and/or servicing work. The tension spring 206 is coupled to the stationary stop 207 and to the holding device 203 in such a way that in the servicing position (FIG. 14) it is located with respect to the shaft 208 on the other side than in the remaining positions (FIG. 12, 13) so that it acts as an over-dead-center spring that secures the holding device 203 in the servicing position (FIG. 14).

The piecing process in the case of the embodiment according to FIGS. 12 to 14 that is carried out starting from the piecing position (FIG. 13) takes place essentially in the way that is described corresponding to the embodiment according to FIGS. 1 to 5. It may also be carried out manually or by means of a mobile piecing unit. First, care is taken that slivers enter into the suction tubes 225, i.e., that slivers are located correctly in the drafting roller device 1. Then the drafting roller devices 1 are closed by the moving-back of the load arm 12 and the connected applying of the top rollers 11, so that the sliver supply starts. The sliver that has not yet been drafted correctly during the starting phase is inserted into the suction tubes 225 and sucked off. The closing of the drafting roller device 1 may take place by means of the fact that the load arm 12 is pressed back into the operating position (FIG. 12), in which case the pressure rod 221 takes along the suction tubes 225 and pulls them back from the area of the delivery rollers 11, 13. In addition, the stop 223 is moved back, so that the securing lever 211 is also brought into the operating position by the spring 216.

In the case of a different embodiment, as shown in FIGS. 12 to 14, it is provided, on the other hand, that starting from the piecing Position (FIG. 13), the holding device 203 is lifted slightly, in which case the swivel arm 209 swivels around its shaft 210. At the swivel arm 209, a leaf spring 227 is mounted to which a switch 229 is assigned that is connected via an electric line 230 with the valve of the pneumatic press 219 and that, in the case of a corresponding actuating of the pneumatic press 219, emits the signal to pull back the piston 218. In this case, the closing of the drafting roller device 1 and the pulling-back of the suction tubes 225 takes place by means of the concerned spinning unit itself. As the next step, the holding device 203 is lifted into its operating position, so that the inlet 204 of the first air nozzles arrives in the area of the wedge-shaped gap of the pairs of delivery rollers 11, 13 and takes over the moving sliver 4, 5 that is cut in the process. The part located in the suction tubes 225 is sucked off. During the continued lifting, the pivot 214 of the swivel arm 209 will move against a diagonal stopping face of the securing lever 211 that in the process is lightly deflected, until the recess 213 reaches around the pivot 214 and thus again secures the swivel arm 209 and the holding device 203 in the operating position. During the piecing, a suction gripping means is also applied to a bifurcated guiding element of the holding device 203, so that the slivers 4, 5 are sucked up and taken over. Then the inserting takes place into the withdrawal device 3 and the transfer to the wind-up device in the manner described by means of FIGS. 1 to 5.

Figure 15:
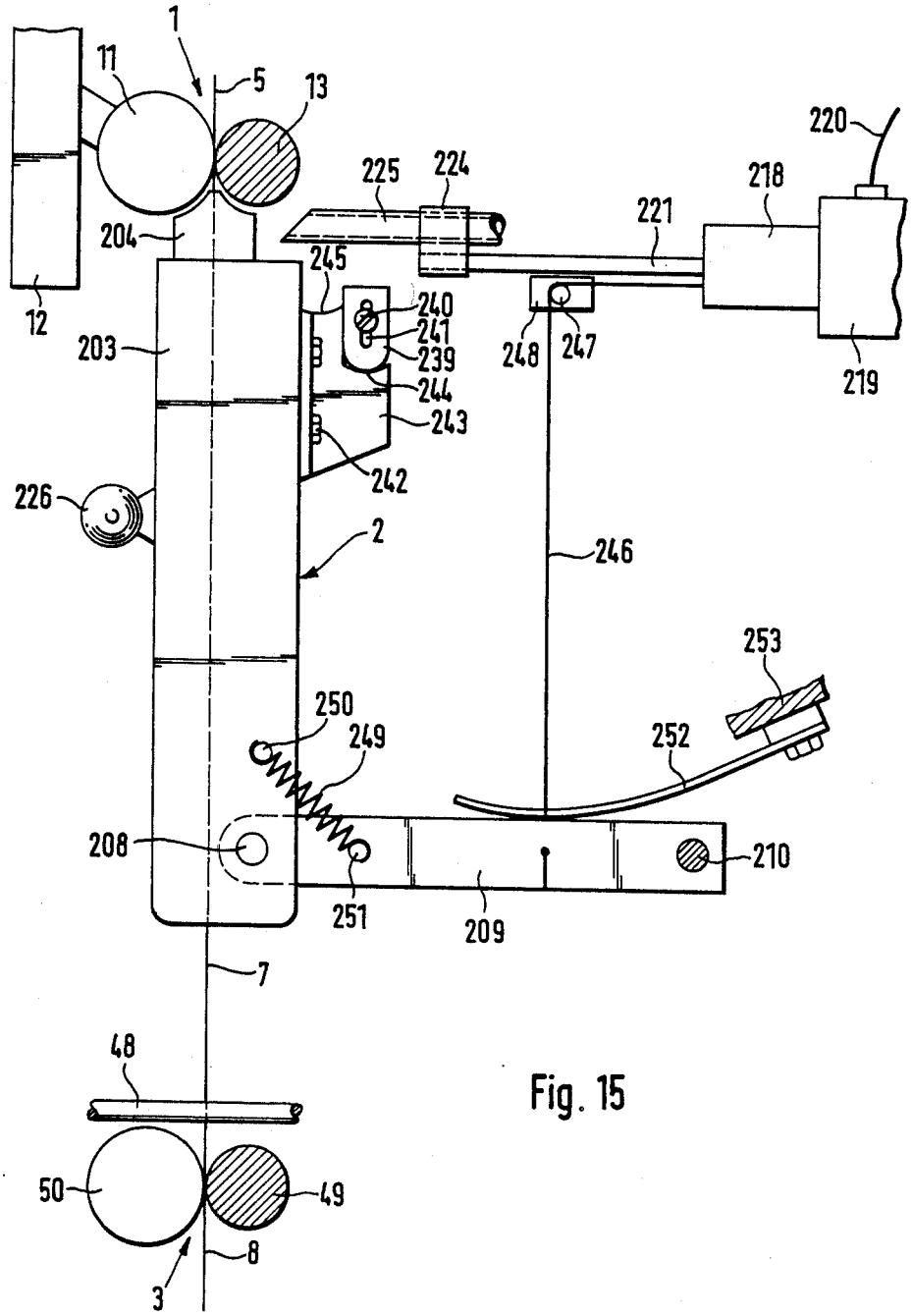
FIG. 15 is a schematic view similar to FIG. 12 showing an embodiment in which a joint adjusting mechanism is provided for the holding device for the air nozzles and suction tubes.

In FIG. 15, an embodiment is shown that, to a large part, corresponds to the embodiment according to FIGS. 12 to 14. Here also, a holding device 203 for air nozzles is provided that may be constructed according to one of the embodiments of FIGS. 1 to 11. The holding device 203 is held by means of a swivel arm 209 that can be swivelled around a shaft 210 that extends in the longitudinal direction of the machine. The connection between the swivel arm 209 and the holding device 203 takes place via a shaft 208 that extends in parallel to the swivel shaft 210. The swivel arm 209, by means of a tension element 246, a tension rope or a tension band, is connected with the piston 218 of a pneumatic press 219. The tension element 246 is guided via a deflecting element 247 that is stationarily arranged on a holding element 248. When the piston 218 of the pneumatic press 219 moves out, the compressed-air supply of the press 219 being controlled via a valve that is supplied via an electric line 220 with a corresponding signal from the yarn guards, the tension element 246 will relax so that the holding device 203, because of its inherent weight, is lowered into the piecing position. The amount of the lowering is determined by the move-out path of the piston 218 and thus by the movement of the tension element 246. In the case of this embodiment, the lowering is supported by a leaf spring 252 affecting the swivel arm 209, the other end of which leaf spring 252 being fixed at a stationary component 253.

In the operating position (FIG. 15) and in the piecing position, the holding device 203 is secured at a stationarily arranged stop 239. The stop 239 that is held so that it can be adjusted by means of an oblong hole 241 extending in the direction of the lowering movement and a fastening screw 240 engages with an arched part in a cup-shaped indentation 244 of a stop counterpart 243 that is fastened at the holding device 203 by means of screws 242. In this way, a type of locking connection is created so that the holding device 203 with the air nozzles, the inlet parts 204 of which project very far into the wedge-shaped gap of the pair 11, 13 of delivery rollers of the drafting roller device 1, also in the case of machine vibrations, is sufficiently secured with respect to position changes. Between the swivel arm 209 and the holding device 203, a tension spring 249 is arranged that is suspended into a pivot 250 of the holding device 203 and a pivot 251 of the holding means 209. The tension spring 249 ensures that the stop counterpiece 243, during the lowering movement, remains at a corresponding surface of the stop 239). The upper end of the stop counterpiece 243 is provided with another cup-shaped indentation 245 that, in the piecing position, locks over the end of the stop 239 and thus also forms a type of locking securing means in the piecing position.

Starting from the piecing position, the holding device 203 may be swivelled away around the shaft 208 into an at least approximately horizontal servicing position, in which case the locking securing unit formed by the stop 239 and the surface 245 must be overcome by the application of a certain force. The stop 239 and/or the stop counterpiece 243 are advantageously made of a plastic material in especially preferred embodiments.

At the piston 218 of the pneumatic press 219, a pressure rod 221 is mounted that carries two suction tubes 225 via a holding bracket 224. These suction tubes 225 are applied to the area of the wedge-shaped gap of the pairs of delivery rollers 11, 13 of the drafting roller device 1 when the holding device 203 is lowered into the piecing position. During the transfer into the piecing position, the supply of the drafting roller device 1 is interrupted. This may take place by the fact that either, by means of a special transmitting mechanism, the movement of the piston 218 is also transmitted to the load arm 12 of the drafting roller device 1. It is also contemplated to provide a separate actuating member that is assigned to the load arm 12 and that is operated by the yarn guards.

In the case of another embodiment, a sliver-stopping device is provided, for example, according to German Published Unexamined Application (DE-OS) No. 30 48 481, by means of which the supply of the drafting roller device 1 can be interrupted without any lifting-off of the load arm 12.

Also in the case of this embodiment, the piecing process is carried out in such a way that first the supply of sliver 5 is started that first enters into the suction tubes 225. Then the holding device 203 with the air nozzles is brought into the operating position (FIG. 15) so that the inlet point 204 projects far into the wedge-shaped gap between the pairs of delivery roller 11, 13 of the drafting roller device 1. Simultaneously, the suction tubes 225 are pulled back. Apart from that, the piecing process takes place in a way that corresponds to the above-explained piecing processes of FIGS. 1 to 5 and 12 to 14.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An arrangement for pneumatic false-twist spinning of the type having pneumatic false-twist nozzle means interposed between delivery roller means of a sliver supplying drafting frame and yarn withdrawal device means, said arrangement comprising:

pneumatic false-twist nozzle means having sliver inlet means for accepting sliver from drafting frame delivery roller means, nozzle adjusting means for adjustably moving the nozzle means between an operating position with the sliver inlet means disposed adjacent the delivery roller means and a piecing position with the sliver inlet means disposed offset with respect to the delivery roller means, and suction tube means movable between an inoperative position spaced from the delivery roller means to a piecing position adjacent the delivery roller means, said suction means being operable to control withdrawal of said sliver from the delivery roller means for piecing operations thereby assuring a correctly drafted sliver being available for piecing.

2. An arrangement according to claim 1, wherein said nozzle adjusting means includes means for the joint transfer of pneumatic nozzle means and the suction tube means into the piecing position.

3. An arrangement according to claim 2, wherein the means for the joint transfer contains triggering element that is controlled by a yarn guard.

4. An arrangement according to claim 1, wherein delivery roller interrupting means are provided for interrupting the supply of the delivery roller means that are controlled by a yarn guard.

5. An arrangement according to claim 3, wherein delivery roller interrupting means are provided for interrupting the supply of the delivery roller means that are controlled by a yarn guard.

6. An arrangement according to claim 2, wherein delivery roller interrupting means are provided for interrupting the supply of the delivery roller means that are controlled by a yarn guard.

7. An arrangement according to claim 6, wherein said nozzle adjusting means and the delivery roller interrupting means utilize an actuating mechanism that contains a joint actuating element that is controlled by a yarn guard.

8. An arrangement according to claim 7, wherein the actuating mechanism is designed in such a way that at least the supply of the delivery roller means can start operation in the piecing position of the pneumatic nozzle means.

9. An arrangement according to claim 1, wherein the pneumatic nozzle means are held by means of a joint, movably arranged holding means.

10. An arrangement according to claim 9, wherein at least one of the pneumatic nozzle means is movably mounted relative to the holding means.

11. An arrangement for pneumatic false-twist spinning of the type having pneumatic false-twist nozzle means interposed between delivery roller means of a sliver supplying drafting frame and yarn withdrawal device means, said arrangement comprising:

pneumatic false-twist nozzle means having sliver inlet means for accepting sliver from drafting frame delivery roller means, nozzle adjusting means for adjustably moving the nozzle means between an operating position with the sliver inlet means disposed adjacent the delivery roller means and a piecing position with the sliver inlet means disposed offset with respect to the delivery roller means, and suction tube means movable between an inoperative position spaced from the delivery roller means to a piecing position adjacent the delivery roller means, said suction means being operable to control said sliver for piecing operations, wherein the pneumatic nozzle means includes two rows of pneumatic nozzles, wherein a joint withdrawal device for double yarn are assigned to two adjacent drafting roller means equipped with a pressure roller twin serving as said delivery roller means, and wherein all pneumatic nozzle means are arranged on a joint holding means.

12. An arrangement according to claim 11, wherein the two rows of pneumatic nozzles approach one another in a V-shape in the travel direction of the yarn.

13. An arrangement according to claim 11, wherein a bifurcated guiding element is connected behind the pneumatic nozzles of both rows, said bifurcated guiding element containing guiding ducts that are assigned to the two rows, said guiding ducts leading out into a joint connecting surface.

14. An arrangement according to claim 12, wherein a bifurcated guiding element is connected behind the pneumatic nozzles of both rows, said bifurcated guiding element containing guiding ducts that are assigned to the two rows, said guiding ducts leading out into a joint connecting surface.

15. An arrangement according to claim 13, wherein guiding elements with guiding ducts are arranged between the outlet of the last air nozzle and the bifurcated guiding element.

16. An arrangement according to claim 1, wherein adjustable covering elements are provided in order to at least partially close gaps between the pneumatic nozzle means and associated guiding elements.

17. An arrangement according to claim 11, wherein the joint holding means is provided with two groove-shaped guide means extending in the travel direction (A) of the yarn into and into which guide means the pneumatic nozzles and associated guiding elements are inserted.

18. An arrangement according to claim 17, wherein means are provided for moving the joint holding means from the piecing position into a servicing position.

19. An arrangement according to claim 18, wherein the joint holding means has a plate-shaped design and is provided on its back with means for the holding of the pneumatic nozzles.

20. An arrangement according to claim 18, wherein said joint holding means is provided on its back with means for holding guiding elements and means for the supply of compressed air to the pneumatic nozzles.

21. An arrangement according to claim 18, wherein the holding means can be swivelled around a horizontal shaft into the servicing position in which it is in an approximately horizontal position.

22. An arrangement according to claim 18, wherein the holding means can be swivelled around a horizontal shaft into the servicing position in which is in an approximately horizontal position.

23. An arrangement according to claim 1, wherein the pneumatic nozzle means includes two rows of pneumatic nozzles, wherein a joint with drawal device for double yarn are assigned to two adjacent drafting roller means equipped with a pressure roller twin serving as said delivery roller means, and wherein all pneumatic nozzle means are arranged on a joint holding means.

24. An arrangement according to claim 23, wherein the two rows of pneumatic nozzles approach one another in a V-shape in the travel direction of the yarn.

25. An arrangement according to claim 23, wherein a bifurcated guiding element is connected behind the pneumatic nozzles of both rows, said bifurcated guiding element containing guiding ducts that are assigned to the two rows, said guiding ducts leading out into a joint connecting surface.

26. An arrangement according to claim 24, wherein a bifurcated guiding element is connected behind the pneumatic nozzles of both rows, said bifurcated guiding element containing guiding ducts that are assigned to the two rows, said guiding ducts leading out into a joint connecting surface.

27. An arrangement according to claim 25, wherein guiding elements with guiding ducts are arranged between the outlet of the last air nozzle and the bifurcated guiding element.

28. An arrangement according to claim 23, wherein the joint holding means is provided with two groove-shaped guide means extending in the travel direction (A) of the yarn into and into which guide means the pneumatic nozzles and associated guiding elements are inserted.

29. An arrangement according to claim 28, wherein means are provided for moving the joint holding means from the piecing position into a servicing position.

30. An arrangement according to claim 29, wherein the joint holding means has a plate-shaped design and is provided on its back with means for holding of the pneumatic nozzles.

31. An arrangement according to claim 29, wherein said joint holding means is provided on its back with means for holding guiding elements and means for the supply of compressed air to the pneumatic nozzles.

32. An arrangement according to claim 29, wherein the holding means can be swivelled around a horizontal shaft into the servicing position in which it is in an approximately horizontal position.

33. An arrangement according to claim 29, wherein the holding means can be swivelled around a horizontal shaft into the servicing position in which is in an approximately horizontal position.

* * * * *